US009999274B2

(12) United States Patent
Henderson et al.

(10) Patent No.: US 9,999,274 B2
(45) Date of Patent: Jun. 19, 2018

(54) SHOE HAVING MULTIPLE SOLE MEMBERS

(71) Applicant: Cole Haan LLC, New York, NY (US)

(72) Inventors: Jeff Henderson, New York, NY (US); George Chiou, Beaverton, OR (US)

(73) Assignee: COLE HAAN LLC, New York, NY (US)

( * ) Notice: Subject to any disclaimer, the term of this patent is extended or adjusted under 35 U.S.C. 154(b) by 669 days.

(21) Appl. No.: 14/051,092

(22) Filed: Oct. 10, 2013

(65) Prior Publication Data

US 2015/0101215 A1 Apr. 16, 2015

(51) Int. Cl.

| | |
|---|---|
| ***A43B 3/00*** | (2006.01) |
| ***A43B 13/12*** | (2006.01) |
| ***A43B 13/14*** | (2006.01) |
| ***A43B 13/18*** | (2006.01) |

(52) U.S. Cl.

CPC ..... *A43B 3/0057* (2013.01); *A43B 13/125* (2013.01); *A43B 13/141* (2013.01); *A43B 13/187* (2013.01)

(58) Field of Classification Search

CPC ..... A43B 13/00; A43B 13/12; A43B 13/14; A43B 13/141; A43B 13/223

USPC ..... 36/103, 25 R, 30 R, 30 A

See application file for complete search history.

(56) References Cited

U.S. PATENT DOCUMENTS

| | | | | |
|---|---|---|---|---|
| 2,201,300 | A * | 5/1940 | Prue | 36/19.5 |
| 3,061,950 | A * | 11/1962 | Levine | 36/3 R |
| 4,030,213 | A | 6/1977 | Daswick | |
| 4,161,829 | A | 7/1979 | Wayser | |
| 4,559,723 | A | 12/1985 | Hamy et al. | |
| 4,638,577 | A | 1/1987 | Riggs | |
| 4,748,753 | A | 6/1988 | Ju | |
| D324,131 | S | 2/1992 | Lucas | |
| 5,146,697 | A | 9/1992 | Weiss | |
| D344,169 | S | 2/1994 | Brown et al. | |
| 5,353,522 | A | 10/1994 | Wagner | |
| 5,915,820 | A | 6/1999 | Kraeuter et al. | |
| 6,023,859 | A | 2/2000 | Burke et al. | |
| D435,958 | S | 1/2001 | White | |
| 6,192,605 | B1 | 2/2001 | Challant | |
| D469,949 | S | 2/2003 | Koo | |
| D473,041 | S | 4/2003 | Finkelberg | |

(Continued)

OTHER PUBLICATIONS

Plastics International, "Hardness Scale—Durometer Comparisons of Materials," 2015.*

(Continued)

*Primary Examiner* — Khoa Huynh
*Assistant Examiner* — Jocelyn Bravo
(74) *Attorney, Agent, or Firm* — Thompson Coburn LLP

(57) ABSTRACT

A shoe comprises a sole and an upper. The sole comprises a lower sole member and an upper sole member. The lower sole member includes a plurality of sipes and a longitudinal cavity. The longitudinal cavity is at least in a sole midfoot region and extends downwardly from a top surface of the lower sole member. The plurality of sipes extend upwardly from the bottom surface of the lower sole member and intersect the longitudinal cavity such that the plurality of sipes and the longitudinal cavity combine to define a plurality of through openings. The upper sole member is within the cavity and covers the plurality of through openings.

12 Claims, 8 Drawing Sheets

(56) References Cited

U.S. PATENT DOCUMENTS

D474,880 S 5/2003 Cintron
6,578,290 B1 6/2003 Meynard
6,601,319 B1 8/2003 Clements
6,634,121 B2 10/2003 Sordi
6,662,667 B2 12/2003 Kobayashi et al.
6,678,970 B2 1/2004 Liu
D490,225 S 5/2004 McClaskie
6,748,674 B2 6/2004 Ellis, III
D495,128 S 8/2004 Avar
6,772,539 B1 8/2004 Tai
6,843,000 B1 1/2005 Park
6,990,755 B2 1/2006 Hatfield et al.
D514,288 S 2/2006 Burg
7,003,902 B2 2/2006 Chen et al.
7,093,379 B2 8/2006 Ellis, III
7,155,843 B2 1/2007 Meschan
7,171,767 B2 2/2007 Hatfield et al.
D546,033 S 7/2007 Matis et al.
D546,044 S 7/2007 Matis et al.
D548,436 S 8/2007 Wolff
7,287,341 B2 10/2007 Ellis, III
7,290,357 B2 11/2007 McDonald et al.
D568,594 S 5/2008 Ringholz
7,380,350 B2 6/2008 Meschan et al.
7,392,605 B2 * 7/2008 Hatfield et al. ..... 36/97
D575,040 S 8/2008 Bramani
7,451,557 B2 11/2008 McDonald et al.
D584,887 S 1/2009 Earle
D594,639 S 6/2009 Alfaro
D595,047 S 6/2009 Petrie
D597,289 S 8/2009 Chang
7,607,241 B2 10/2009 McDonald et al.
D611,692 S * 3/2010 Bizzo ..... D2/960
7,752,772 B2 7/2010 Hatfield et al.
7,946,058 B2 5/2011 Johnson et al.
D644,418 S 9/2011 Yi
8,061,059 B2 11/2011 Bruce et al.
D649,754 S 12/2011 Callahan et al.
8,074,379 B2 12/2011 Robinson, Jr. et al.
8,104,197 B2 1/2012 Flannery et al.
8,125,796 B2 2/2012 Ellis
8,141,276 B2 3/2012 Ellis
8,146,270 B2 4/2012 Aveni et al.
8,156,593 B2 4/2012 Ho
D659,964 S 5/2012 Callahan et al.
D659,965 S 5/2012 Callahan et al.
8,186,079 B2 * 5/2012 Carboy et al. ..... 36/59 C
8,186,081 B2 5/2012 Wilson, III et al.
8,196,316 B2 6/2012 Cook et al.
8,196,318 B2 6/2012 Kosta
8,205,356 B2 6/2012 Ellis
D662,699 S 7/2012 Callahan et al.
8,220,186 B2 7/2012 Nomi et al.
8,225,533 B2 * 7/2012 Meschan ..... 36/35 R
8,303,885 B2 * 11/2012 Hatfield et al. ..... 264/328.1
D671,723 S 12/2012 Teteriatnikov
D674,581 S 1/2013 Callahan et al.
D675,003 S 1/2013 Leon et al.
8,479,417 B2 7/2013 Flannery et al.
8,505,215 B2 8/2013 Bruce et al.
2002/0116841 A1 8/2002 Ellis
2006/0032086 A1 2/2006 Ellis
2007/0186446 A1 * 8/2007 Lafortune ..... 36/43
2008/0022553 A1 * 1/2008 McDonald et al. ..... 36/25 R
2008/0222920 A1 * 9/2008 Rovida ..... 36/100
2008/0263900 A1 * 10/2008 Determe et al. ..... 36/107
2009/0049714 A1 * 2/2009 Abadjian et al. ..... 36/103
2009/0165336 A1 * 7/2009 Anderson ..... 36/103
2011/0099845 A1 * 5/2011 Miller ..... 36/91
2011/0126428 A1 * 6/2011 Hazenberg et al. ..... 36/103
2011/0138659 A1 * 6/2011 Park ..... 36/25 R
2011/0179669 A1 * 7/2011 Hanebrink et al. ..... 36/28
2012/0090199 A1 * 4/2012 Flannery et al. ..... 36/83
2012/0210603 A1 * 8/2012 Ellis ..... 36/83
2012/0210606 A1 * 8/2012 Gheorghian et al. ..... 36/103
2012/0210607 A1 * 8/2012 Avar et al. ..... 36/103
2012/0227289 A1 * 9/2012 Beers et al. ..... 36/25 R
2012/0260528 A1 * 10/2012 Cook et al. ..... 36/99
2013/0000159 A1 * 1/2013 Hatfield et al. ..... 36/59 C
2013/0019505 A1 * 1/2013 Borel et al. ..... 36/103
2013/0139410 A1 6/2013 Dirsa et al.
2013/0232821 A1 * 9/2013 Schindler et al. ..... 36/103
2013/0333245 A1 * 12/2013 Becker et al. ..... 36/102
2014/0013624 A1 * 1/2014 Stockbridge et al. ..... 36/103
2014/0015169 A1 * 1/2014 Wan et al. ..... 264/328.1
2014/0109440 A1 * 4/2014 McDowell et al. ..... 36/103
2014/0109441 A1 * 4/2014 McDowell et al. ..... 36/103
2014/0165304 A1 * 6/2014 Hazenberg et al. ..... 12/146 B
2014/0277632 A1 * 9/2014 Walker ..... 700/91
2014/0305006 A1 * 10/2014 Azoulay ..... 36/84

OTHER PUBLICATIONS

International Search Report and Written Opinion for PCT/US2014/059928 dated Jan. 21, 2015.

* cited by examiner

SHOE HAVING MULTIPLE SOLE MEMBERS

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

This invention pertains to shoes having multiple sole members.

SUMMARY OF THE INVENTION

One aspect of the invention is a shoe comprising a sole and an upper operatively secured to the sole. The sole comprises a lower sole member and an upper sole member. The lower sole member includes a sole heel region, a sole midfoot region, a sole forefoot region, a medial side, a lateral side, a bottom surface, a top surface, a plurality of sipes, and a longitudinal cavity. The longitudinal cavity is at least in the sole midfoot region and extends downwardly from the top surface of the lower sole member. The plurality of sipes extend upwardly from the bottom surface of the lower sole member and intersect the longitudinal cavity such that the plurality of sipes and the longitudinal cavity combine to define a plurality of through openings. The upper sole member is within the cavity and covers the plurality of through openings.

Further features and advantages of the present invention, as well as the operation of the invention, are described in detail below with reference to the accompanying drawings.

Figure 1:
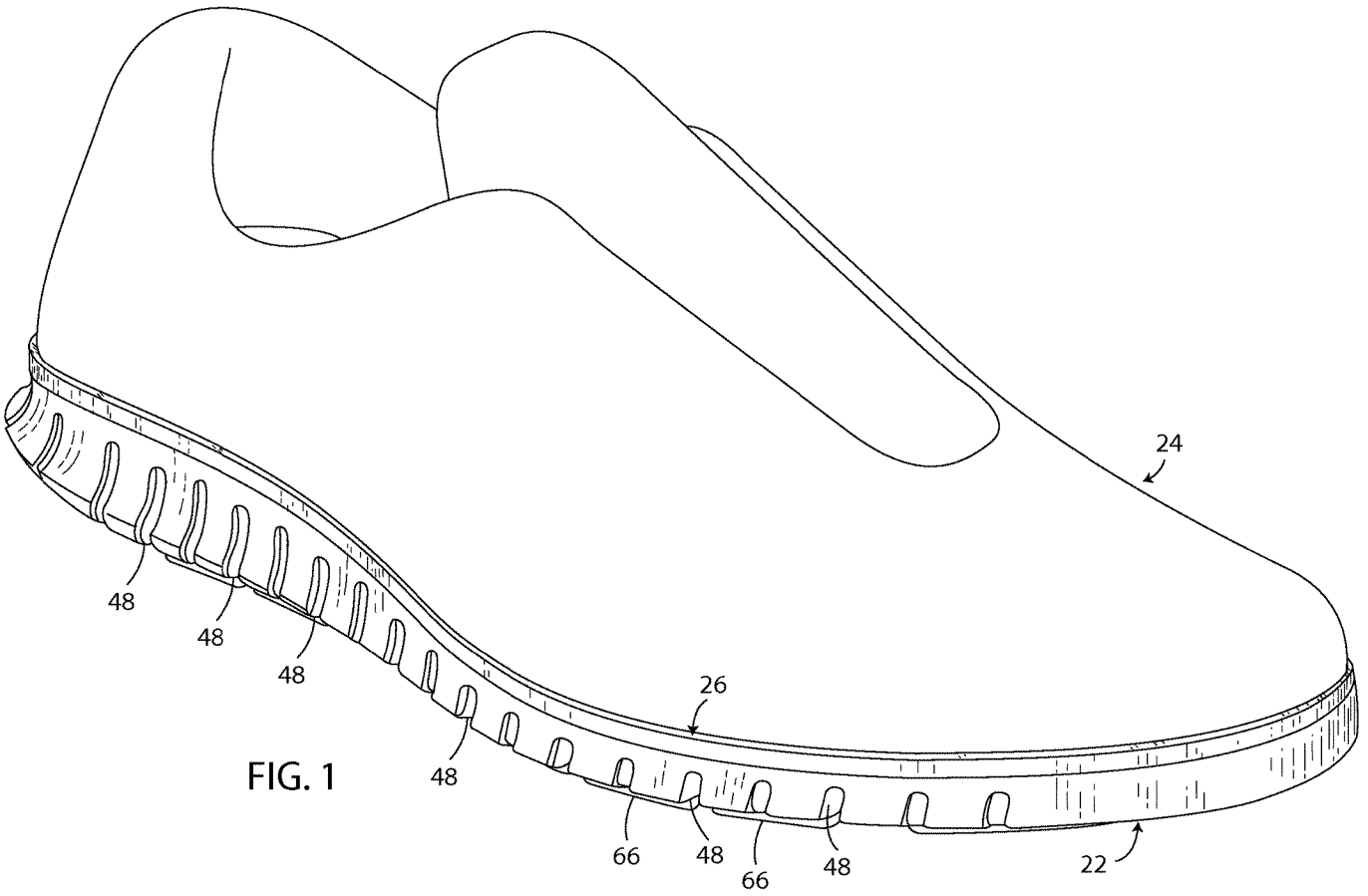
FIG. 1 is a perspective view of an embodiment of a shoe in accordance with the present invention, the shoe including a sole, and an upper.

Reference numerals in the written specification and in the drawing figures indicate corresponding items.

DETAILED DESCRIPTION

An embodiment of a shoe in accordance with the present invention is indicated by reference numeral 20 in FIG. 1.

Figure 2:
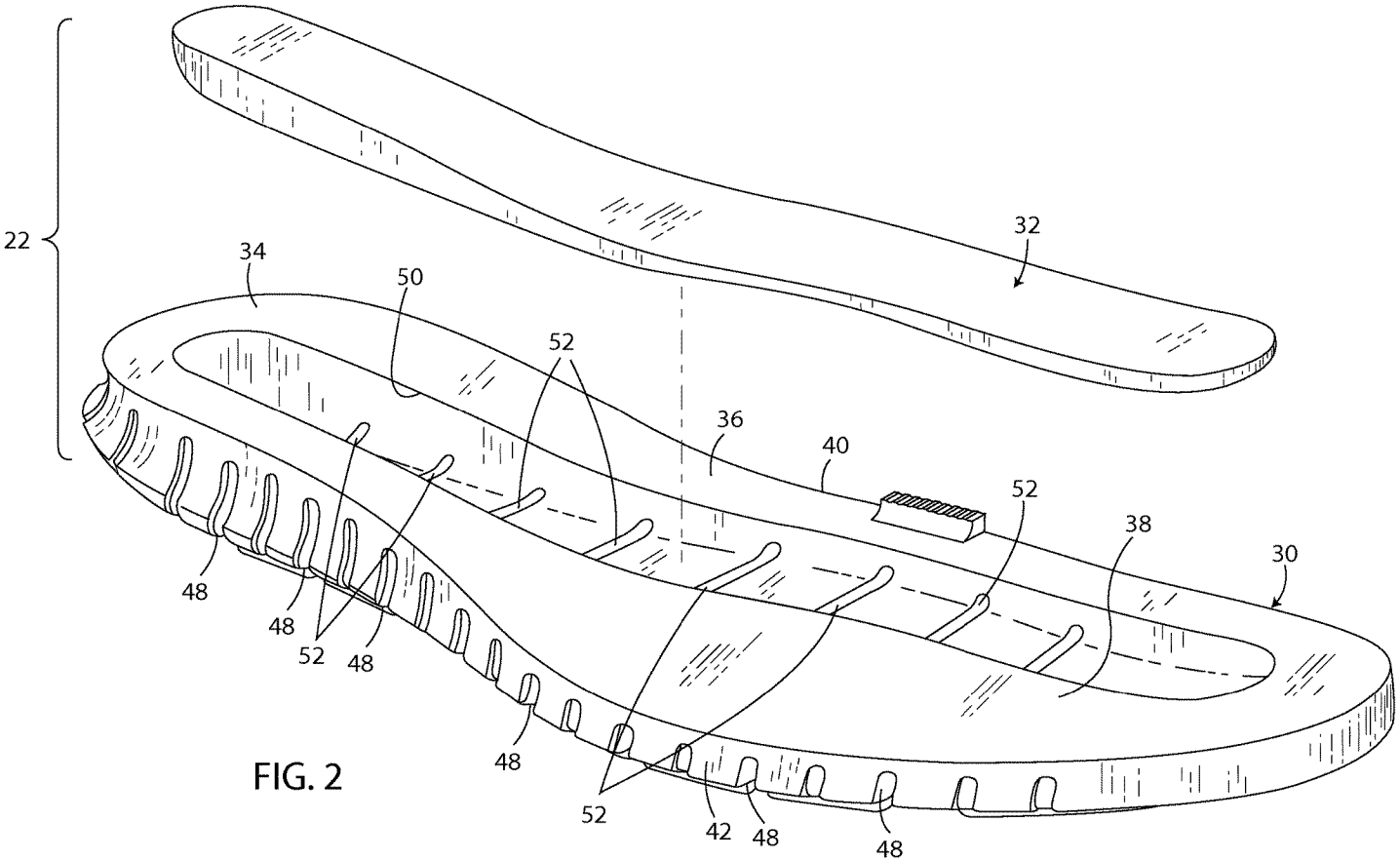
FIG. 2 is an exploded perspective view of the sole of FIG. 1, the sole including a lower sole member and an upper sole member.
Figure 3:
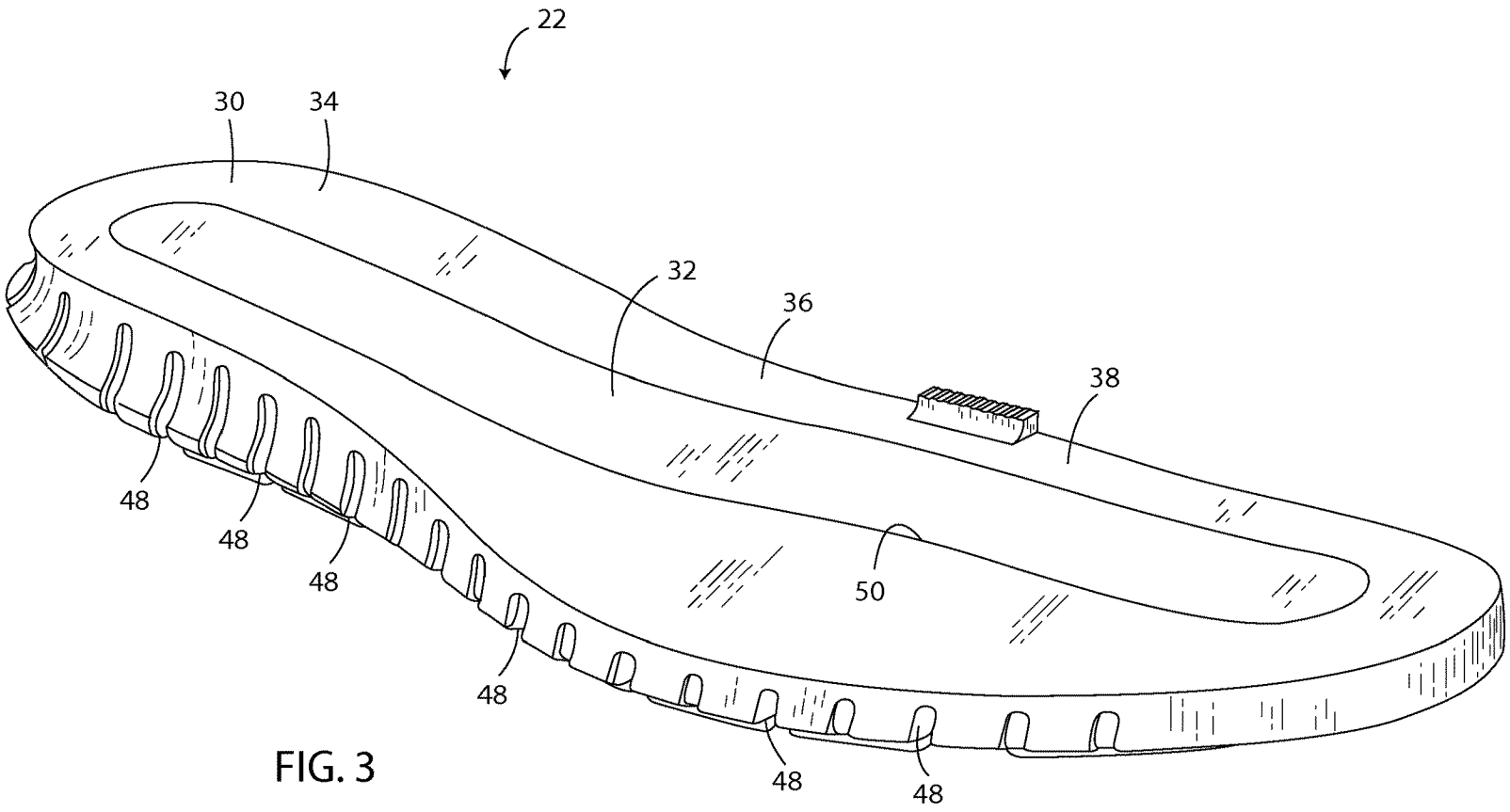
FIG. 3 is a perspective view of the sole of FIG. 1.
Figure 4:
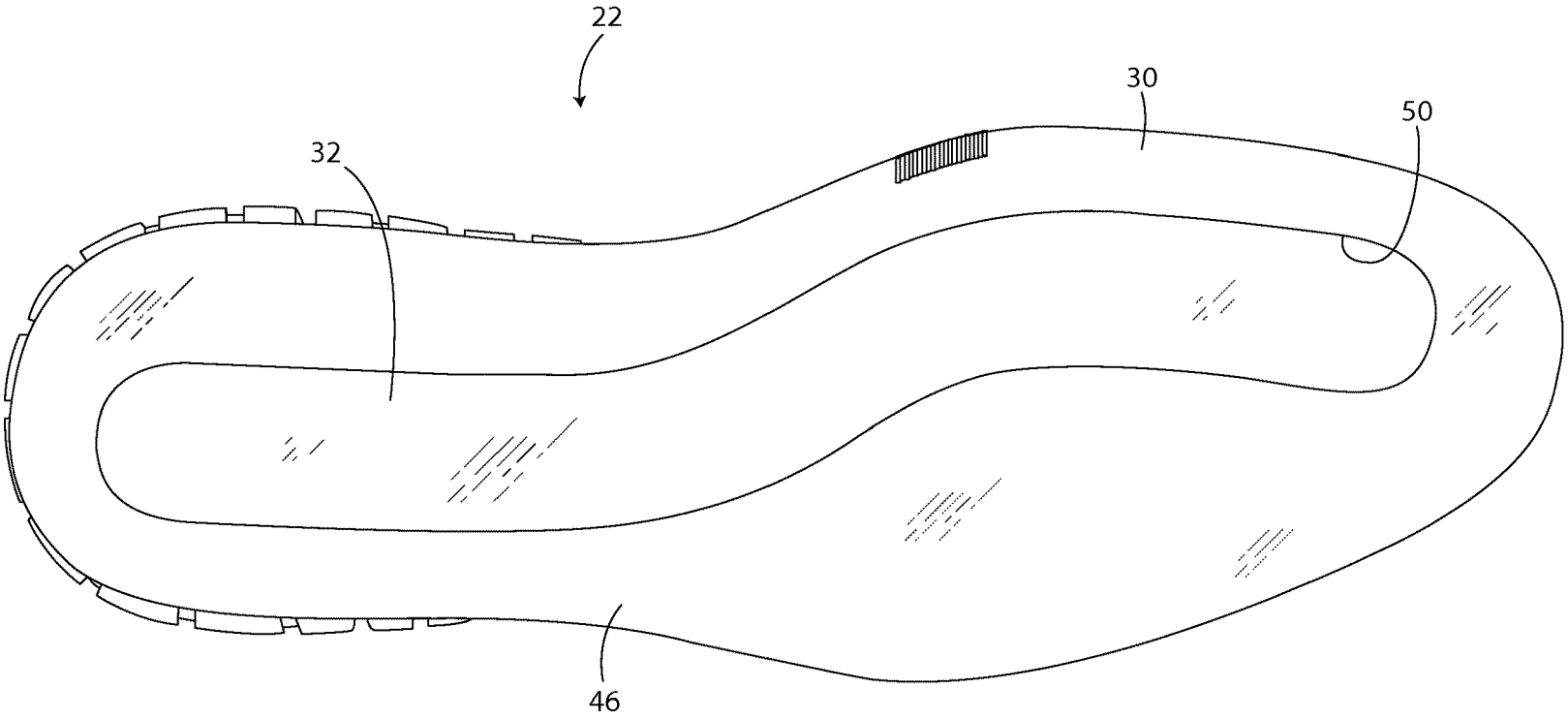
FIG. 4 is a top plan view of the sole of FIG. 1.

The shoe 20 comprises a sole, generally indicated at 22, and an upper, generally indicated at 24. The upper 24 is operatively secured to the sole 22. The shoe 20 may also include a welt, generally indicated at 26. The sole 22 is shown in detail in FIGS. 2-7. The sole 22 comprises a lower sole member 30 and an upper sole member 32. The lower sole member 30 includes a sole heel region 34, a sole midfoot region 36, a sole forefoot region 38, a medial side 40, a lateral side 42, a bottom surface 44, a top surface 46, a plurality of sipes 48, and a longitudinal cavity 50 (see FIG. 2). The longitudinal cavity 50 is at least in the sole midfoot region 36. More preferably, the longitudinal cavity 50 extends from the sole heel region 34 to the sole forefoot region 38 of the lower sole member 30. The longitudinal cavity 50 extends downwardly from the top surface 46 of the lower sole member 30. The plurality of sipes 48 extend upwardly from the bottom surface 44 of the lower sole member 30 and intersect the longitudinal cavity 50 such that the plurality of sipes and the longitudinal cavity combine to define a plurality of through openings 52 (see FIG. 2). The upper sole member 32 is within the cavity 50 and covers the plurality of through openings 52.

The plurality of sipes 48 includes at least a first sipe 60, a second sipe 62, and a third sipe 64. The first sipe 60 is in the sole heel region 34 of the lower sole member 30, the second sipe 62 is in the sole midfoot region 36 of the lower sole member, and the third sipe 64 is in the sole forefoot region 38 of the lower sole member. The first sipe 60 extends transversely from the medial side 40 to the lateral side 42 of the lower sole member 30. The second sipe 62 extends transversely from the medial side 40 to the lateral side 42 of the lower sole member 30. The third sipe 64 extends transversely from the medial side 40 to the lateral side 42 of the lower sole member 30. Preferably, none of the transversely extending sipes intersect with another of the transversely extending sipes. Also preferably, none of the plurality of sipes 48 intersect with another of the plurality of sipes 48.

Figure 5:
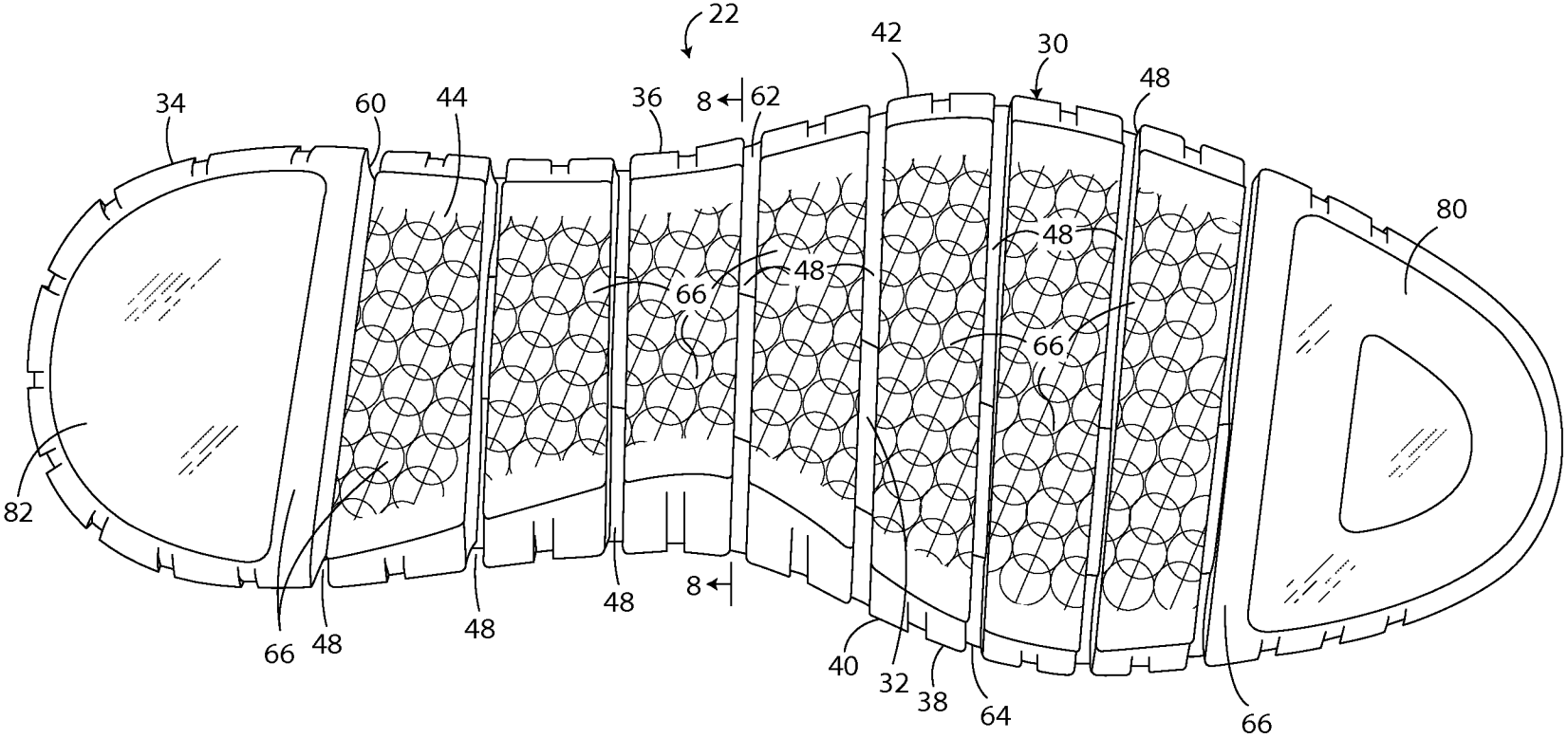
FIG. 5 is a bottom plan view of the sole of FIG. 1.
Figure 6:
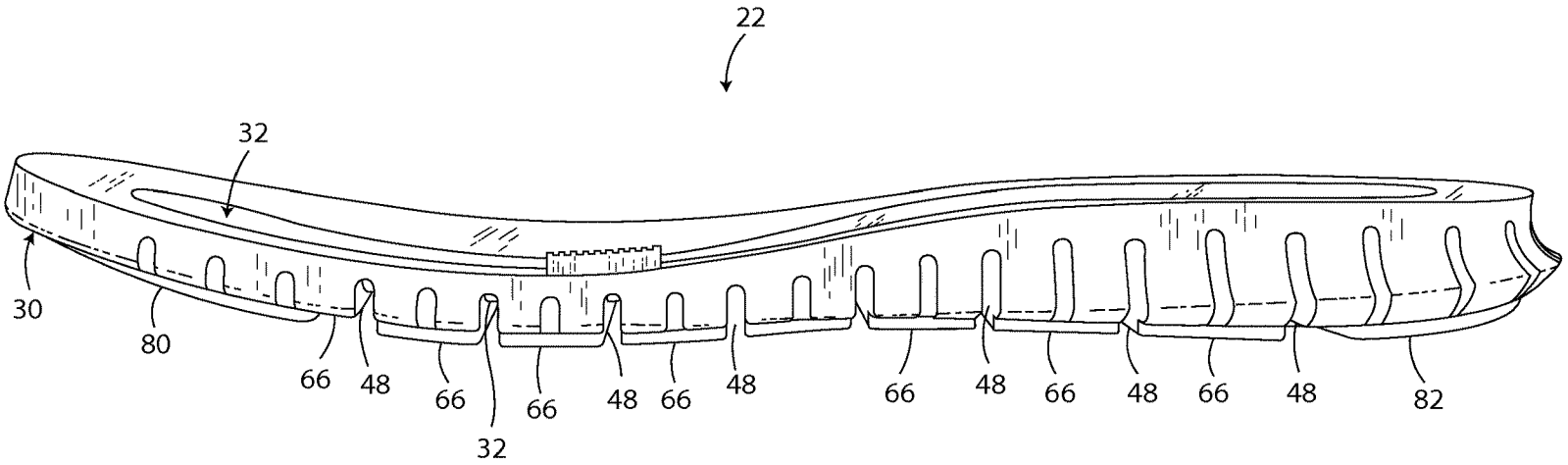
FIG. 6 is a medial side elevational view of the sole of FIG. 1.
Figure 7:
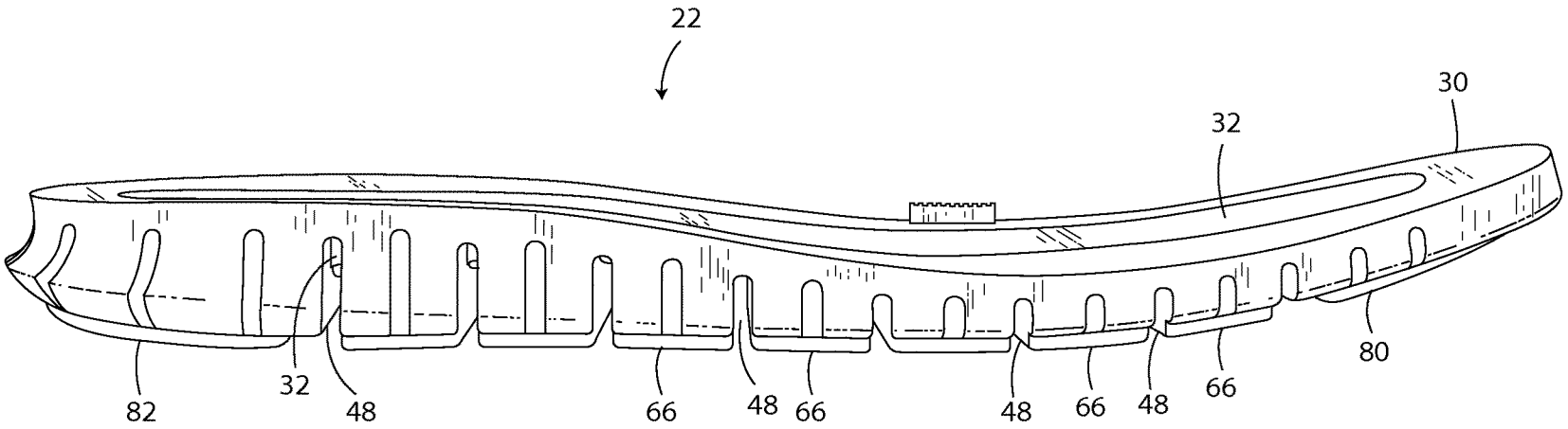
FIG. 7 is a lateral side elevational view of the sole of FIG. 1.

The lower sole member 30 further includes a plurality of ground engaging members 66. Each of the ground engaging members 66 is separated from an adjacent one of the ground engaging members by one of the plurality of sipes 48. Also, as shown in FIGS. 5, 6, and 7, adjacent ground engaging members 66 are spaced apart a sufficient longitudinal distance such that the upper sole member 32 is visible via the sipe 48 separating the adjacent ground engaging members.

The longitudinal cavity 50 includes a cavity heel region 70, a cavity midfoot region 72, and a cavity forefoot region 74. The longitudinal cavity 70 is spaced from the medial side 40 of the lower sole member 30 and is spaced from the lateral side 42 of the lower sole member 30. The cavity forefoot region 74 is closer to the medial side 40 of the lower sole member 30 than to the lateral side 42 of the lower sole member. The cavity heel region 74 is generally midway between the medial and lateral sides 40, 42 of the lower sole member 30, but is preferably closer to the lateral side 42 than to the medial side 40. Preferably, the entirety of the upper sole member 32 is within the longitudinal cavity. Preferably, the top surface of the upper sole member 32 is generally flush with the top surface 46 of the lower sole member 30. The lower sole member 30 is of a first material, which may be a conventional foam material, and the upper sole member 32 is of a second material, which may also be of a conventional foam material, with the second material being different from the first material. Preferably, the first material is of a first durometer hardness and the second material is of a second durometer hardness, with the first durometer hardness being greater than the second durometer hardness. Because of the softness of the upper sole member 32 and the shape of the longitudinal cavity 50, the sole 22 facilitates a gait in which the user initially strikes the ground with the lateral, heel region of the shoe 20 and rolls the shoe to the medial, forefoot of the shoe.

Figure 8:
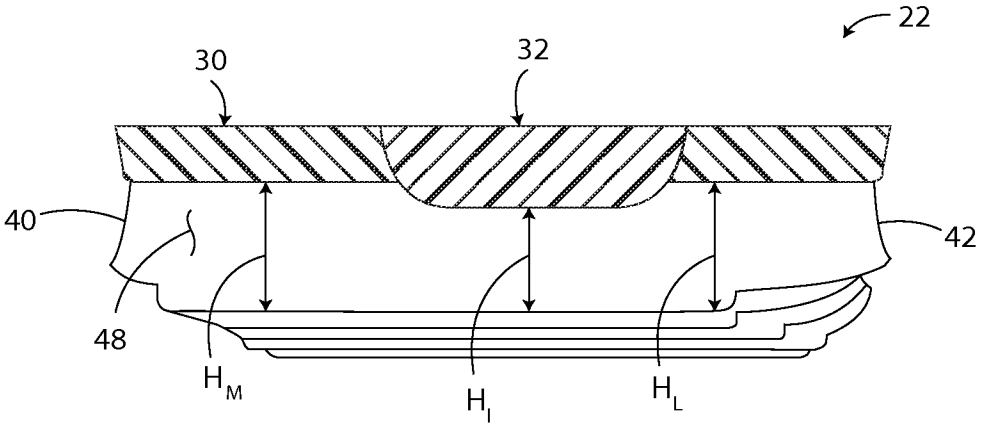
FIG. 8 is a cross-sectional view, taken along the plane of line 8-8 of FIG. 5.

Referring now to FIG. 8, at least one of the plurality of sipes 48 (and preferably each of the plurality of sipes) has a lateral region sipe height $H_L$, a medial region sipe height $H_M$, and an intermediate region sipe height $H_I$. The lateral region sipe height $H_L$ is the height of a lateral region of such sipe 48. The medial region sipe height $H_M$ is the height of a medial region of such sipe 48. The intermediate region sipe height $H_I$ is the height of an intermediate region of such sipe. The lateral region is adjacent the lateral side 42 of the lower sole member 30, the medial region is adjacent the medial side 40 of the lower sole member, and the intermediate region is between the lateral region and the medial region. The intermediate region sipe height $H_I$ is less than the lateral region sipe height $H_L$, and less than the medial region sipe height $H_M$.

The shoe 20 also preferably comprises a forefoot outsole member 80 and a heel outsole member 82. The forefoot outsole member 80 is secured to the sole forefoot region 38 of the lower sole member 30, and the heel outsole member 82 is secured to the sole heel region 34 of the lower sole member. The outsole members 80, 82 are preferably of a more durable (i.e., more wear resistant) material than the lower sole member 30.

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents. While the bottom region of the upper 24 and the top region of the sole 22 are preferably in contact with one another, it is to be understood that other constructions of shoes may be employed without departing from the scope of the invention. For example, a shoe construction in which the bottom region of the upper 24 is spaced from the top region of the sole by a portion of the welt or by some other member still includes a seam as the term seam is used herein.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A shoe comprising a sole and an upper operatively secured to the sole, the sole comprising a lower sole member and an upper sole member, the lower sole member including a sole heel region, a sole midfoot region, a sole forefoot region, a medial side, a lateral side, a bottom surface, a top surface, a plurality of sipes, and a longitudinal cavity, the longitudinal cavity being at least in the sole midfoot region and extending downwardly from the top surface of the lower sole member, the longitudinal cavity extending from the sole heel region to the sole forefoot region of the lower sole member, the plurality of sipes extending upwardly from the bottom surface of the lower sole member and intersecting the longitudinal cavity such that the plurality of sipes and the longitudinal cavity combine to define a plurality of through openings, the upper sole member being within the cavity and covering the plurality of through openings;

wherein said plurality of sipes includes at least a first sipe, a second sipe, and a third sipe, the first sipe being in the sole heel region of the lower sole member, the second sipe being in the sole midfoot region of the lower sole member, and the third sipe being in the sole forefoot region of the lower sole member; and wherein the first sipe extends transversely from the medial side to the lateral side of the lower sole member.

2. A shoe as set forth in claim 1 wherein the second sipe extends transversely from the medial side to the lateral side of the lower sole member.

3. A shoe as set forth in claim 2 wherein the third sipe extends transversely from the medial side to the lateral side of the lower sole member.

4. A shoe comprising a sole and an upper operatively secured to the sole, the sole comprising a lower sole member and an upper sole member, the lower sole member including a sole heel region, a sole midfoot region, a sole forefoot region, a medial side, a lateral side, a bottom surface, a top surface, a plurality of sipes, and a longitudinal cavity, the longitudinal cavity being at least in the sole midfoot region and extending downwardly from the top surface of the lower sole member, the longitudinal cavity extending from the sole heel region to the sole forefoot region of the lower sole member, the plurality of sipes extending upwardly from the bottom surface of the lower sole member and intersecting the longitudinal cavity such that the plurality of sipes and the longitudinal cavity combine to define a plurality of through openings, the upper sole member being within the cavity and covering the plurality of through openings;

wherein at least some of the plurality of sipes extend transversely from the medial side to the lateral side of the lower sole member.

5. A shoe as set forth in claim 4 wherein none of the transversely extending sipes intersect with another of the transversely extending sipes.

6. A shoe as set forth in claim 4 wherein none of the plurality of sipes intersect with another of the plurality of sipes.

7. A shoe comprising a sole and an upper operatively secured to the sole, the sole comprising a lower sole member and an upper sole member, the lower sole member including a sole heel region, a sole midfoot region, a sole forefoot region, a medial side, a lateral side, a bottom surface, a top surface, a plurality of sipes, and a longitudinal cavity, the longitudinal cavity being at least in the sole midfoot region and extending downwardly from the top surface of the lower sole member, the longitudinal cavity extending from the sole heel region to the sole forefoot region of the lower sole member, the plurality of sipes extending upwardly from the bottom surface of the lower sole member and intersecting the longitudinal cavity such that the plurality of sipes and the longitudinal cavity combine to define a plurality of through openings, the upper sole member being within the cavity and covering the plurality of through openings;

wherein the lower sole member is of a first material and the upper sole member is of a second material, the second material being different from the first material;

wherein the first material is of a first durometer hardness and the second material is of a second durometer hardness, the first durometer hardness being greater than the second durometer hardness; and wherein the longitudinal cavity includes a cavity heel region, a cavity midfoot region, and a cavity forefoot region, the cavity forefoot region being closer to the medial side of the lower sole member than to the lateral side of the lower sole member.

8. A shoe as set forth in claim 7 wherein the cavity heel region is generally midway between the medial and lateral sides of the lower sole member.

9. A shoe comprising a sole and an upper operatively secured to the sole, the sole comprising a lower sole member and an upper sole member, the lower sole member including a sole heel region, a sole midfoot region, a sole forefoot region, a medial side, a lateral side, a bottom surface, a top surface, a plurality of sipes, and a longitudinal cavity, the longitudinal cavity being at least in the sole midfoot region and extending downwardly from the top surface of the lower sole member, the longitudinal cavity extending from the sole heel region to the sole forefoot region of the lower sole member, the plurality of sipes extending upwardly from the bottom surface of the lower sole member and intersecting the longitudinal cavity such that the plurality of sipes and the longitudinal cavity combine to define a plurality of through openings, the upper sole member being within the cavity and covering the plurality of through openings;

wherein the lower sole member further includes a plurality of ground engaging members, each of the ground engaging members being separated from an adjacent one of the ground engaging members by one of the plurality of sipes; and wherein one of the ground engaging members and another of the ground engaging members that is adjacent said one of the ground engaging members are spaced apart a sufficient longitudinal distance such that the upper sole member is visible via the sipe separating said one of the ground engaging members and said another of the ground engaging members as viewed in a lateral side elevational view of the shoe.

10. A shoe as set forth in claim 9 wherein the sipe separating said one of the ground engaging members and said another of the ground engaging members extends transversely from the medial side to the lateral side of the lower sole member.

11. A shoe comprising a sole and an upper operatively secured to the sole, the sole comprising a lower sole member and an upper sole member, the lower sole member including a sole heel region, a sole midfoot region, a sole forefoot region, a medial side, a lateral side, a bottom surface, a top surface, a plurality of sipes, and a longitudinal cavity, the longitudinal cavity being at least in the sole midfoot region and extending downwardly from the top surface of the lower sole member, the longitudinal cavity extending from the sole heel region to the sole forefoot region of the lower sole member, the plurality of sipes extending upwardly from the bottom surface of the lower sole member and intersecting the longitudinal cavity such that the plurality of sipes and the longitudinal cavity combine to define a plurality of through openings, the upper sole member being within the cavity and covering the plurality of through openings;

wherein the lower sole member further includes a plurality of ground engaging members, each of the ground engaging members being separated from an adjacent one of the ground engaging members by one of the plurality of sipes; and wherein one of the ground engaging members and another of the ground engaging members that is adjacent said one of the ground engaging members are spaced apart a sufficient longitudinal distance such that the upper sole member is visible via the sipe separating said one of the ground engaging members and said another of the ground engaging members as viewed in a medial side elevational view of the shoe.

12. A shoe as set forth in claim 11 wherein the sipe separating said one of the ground engaging members and said another of the ground engaging members extends transversely from the medial side to the lateral side of the lower sole member.

* * * * *